United States Patent [19]

Zaman

[11] Patent Number: 4,773,353

[45] Date of Patent: Sep. 27, 1988

[54] DIE BAR CARRIER

[75] Inventor: Mohammad F. Zaman, Fort Wayne, Ind.

[73] Assignee: Essex Group, Inc., Fort Wayne, Ind.

[21] Appl. No.: 947,167

[22] Filed: Dec. 29, 1986

[51] Int. Cl.[4] ..... B05C 21/00

[52] U.S. Cl. ..... 118/506; 24/115 G; 118/125; 118/DIG. 22

[58] Field of Search ..... 118/405, 125, DIG. 22, 118/506; 24/115 G

[56] References Cited

U.S. PATENT DOCUMENTS

| | | | |
|---|---|---|---|
| 2,915,580 | 12/1959 | Gill et al. | 174/43 |
| 2,928,636 | 3/1960 | Flower | 248/61 |
| 3,106,386 | 10/1963 | Harris | 263/3 |
| 3,142,588 | 7/1964 | Phillips | 118/407 |
| 3,161,724 | 12/1964 | Greene, Jr. et al. | 174/146 |
| 3,183,604 | 5/1965 | Stauffer | 34/18 |
| 3,183,605 | 5/1965 | Argue et al. | 34/68 |
| 3,265,033 | 8/1966 | Touze et al. | 118/61 |
| 3,271,510 | 9/1966 | Decker et al. | 24/115 G X |
| 3,351,329 | 11/1967 | Thomas | 263/3 |
| 3,596,634 | 8/1971 | Fuchs | 118/65 |
| 3,604,069 | 9/1971 | Jensen | 24/115 G X |
| 3,810,736 | 5/1974 | Dumas | 432/59 |
| 4,303,387 | 12/1981 | Burke et al. | 432/72 |
| 4,365,790 | 12/1982 | Horvath et al. | 266/103 |
| 4,448,578 | 5/1984 | Brunet et al. | 432/72 |
| 4,453,292 | 6/1984 | Bakker | 24/115 G |
| 4,475,294 | 10/1984 | Henricks | 34/79 |
| 4,521,931 | 6/1985 | Katsuki et al. | 8/149 |
| 4,539,931 | 9/1985 | Kikuta et al. | 118/404 |

*Primary Examiner*—John McIntosh

[57] ABSTRACT

A die bar carrier for use in transporting die bars for enameling magnet wire is disclosed. Such a carrier comprises a sleeve having one closed end and one open end, two sleeve cable notches, one sleeve filament notch situated therebetween, and a rod slidably disposed within the sleeve and partly extending through said open end having two rod cable notches corresponding to said sleeve cable notches, and one rod filament notch situated therebetween.

2 Claims, 2 Drawing Sheets

DIE BAR CARRIER

CROSS REFERENCE TO RELATED APPLICATIONS

This application relates to commonly assigned, copending U.S. patent application Ser. No. 867,717 filed May 27, 1986, now U.S. Pat. No. 4,717,604 for DIE BAR CARRIER by Paul E. Justus; and commonly assigned, copending U.S. patent application Ser. No. 941,903 filed Dec. 12, 1986, now U.S. Pat. No. 4,759,960, for DIE BAR WITH INTEGRAL LOCKING MEANS by Mohammad F. Zaman.

TECHNICAL FIELD

The invention relates to wire coating apparatus, more specifically to an apparatus for transporting and positioning die bars within such a wire coating apparatus.

BACKGROUND ART

The production of multi-coated wires, i.e. those wires having a plurality of insulating coats, such as magnet wire, requires that individual wires be coated with successive coats of insulating material. This operation is performed by passing a wire through a series of dies, after immersing the wire in an enamel solution, each die having an increasingly larger diameter than the previous die. Typically, after the application of a coat of insulation, the wire requires curing and drying of the newly formed layer. This is accomplished by passing the newly coated wire through a drying and curing oven, wherein the organic solvents used to dissolve the insulating materials within the enamel are evaporated, and then curing of the insulating material is accomplished. An example of such an enamel solution comprises synthetic polymers, such as nylon, as the insulating enamel material dissolved in organic solvents, such as phenol and cresylic acid.

The wire insulating operation is usually accomplished in a wire insulating apparatus which comprises at least one coating station wherein enamel is supplied and dies are retained, followed by a drying and curing oven, commonly a tall, vertical oven.

The wire to be insulated starts at the coating station having the dies with the smallest internal diameter, the wire passes through the enamel, which may be contained in a trough or "slip", and then through the die which limits the thickness and controls the concentricity of the enamel coat. The wire then passes upward through the oven where the material is dried and cured and then after exiting the oven may be returned to a second enameling station wherein a second die having a larger internal diameter is located. Each "pass", comprising the steps of coating the wire with a coat of insulating enamel followed by drying and curing, then returning the coated wire to the next station until the wire is coated with the desired number of insulating layers. The route of the wire through a pass defines the "process path".

To facilitate this process, the dies may be contained within a "die bar", an apparatus having a generally rectangular shape and at least one die hole passing through the die bar wherein at least one die is positioned, and an internal passage communicating with one surface of the die bar and with a die hole which provides a conduit through which enamel may be supplied from an exterior source at the station and into the interior of the die bar at a point below the die. Wire at a coating station passing upward through the die bar for coating passes first through the enamel and then through the die and, upon exiting, then passes into the drying and curing oven. Advantages of the use of such die bar is that, typically, magnet wire production involves the simultaneous coating of multiple wires in a multiple pass process, and the use of die bars containing dies of successively increasing diameters located along successive stations within the wire insulating apparatus allows for the rapid production of a multitude of individual insulated wires. This method of production provides economies of scale which decrease product cost.

To utilize this method of production, it is required that at the beginning of any production run, the individual wires be first threaded through the plurality of die bars, then the die bars must be transported through the process path and individual die bars be released sequentially one to each ccorresponding station, and then fastened at each station before full scale production may be begun.

One method of locating the die bars at their appropriate successive stations is accomplished by stacking the die bars in series, threading the individual wires through each of the dies in the die bars, and transporting them along the process path by use of an apparatus such as a pair of parallel transport cables. The transport cables extend along the process path of the apparatus for all the passes through which the product wire must travel before insulation with the desired number of coats is completed. A short piece of "carrier" wire, which may be any wire sufficient to withstand the oven temperatures, is partly wrapped around one of the transport cables, then individually wrapped around the die bars so to retain their position relative to one another, and then the remaining part of the carrier wire is wrapped around the other transport cable. In this fashion, the die bars are retained in their sequential order and may be drawn through the apparatus when the transport cables are moved. As each station is approached, the transport cables may be stopped and the lowest die bar disengaged and fastened to the station. Afterwards, the carrier wire is then re-wrapped around the transport cable, the transport cables moved again forward to the next station where the next succeeding die bar may be released. This is repeated until all the die bars have been suitably positioned after corresponding stations, after which the carrier wire may be removed.

An apparatus entitled "Die Bar Carrier" disclosed in pending U.S. patent application Ser. No. 867,617, filed on May 27, 1986, by Paul E. Justus, discloses a die bar carrier having a beam portion having two notched ends and a leaf spring which is centrally and pivotally fastened to the central portion of the beam. The spring ends are fashioned so to extend between the notches in the ends of the beam to the opposite side of the beam when compressed. This apparatus provides a die bar carrier which may be utilized and retains the die bars in a more rigid position than use of the aforementioned "carrier wire". The disclosed die bar carrier is used by fastening it to the parallel transport cables by locating it between and perpendicular to both of the transport cables, then engaging the spring ends through the notches by compressing the spring, positioning the transport cables between the portion of the spring extending between the notch and beyond the bar, and then releasing the spring, so that upon release, the spring retracts to its uncompressed position until its motion is halted by virtue of the transport cables passing at the ends of the bar.

In use, the transport cables are started and, at each station, the transport spring must be disengaged and rotated to an orientation perpendicular to the bar portion of the die bar carrier so to allow the removal of the die bar carrier from between the wires which extend below the lowest die bar. The die bar may then be released and secured at the suitable station. Thereafter, the die bar carrier may be reinserted between the wire extending from the secured die bar and the lowest remaining die bar, re-rotated so to assume the locking position, and then the spring is compressed and reattached to the parallel transport cables. This process continues until the die bars are positioned at their respective stations and, thereafter, the die bar carrier may be removed from the apparatus.

The aforementioned methods provide two workable alternative apparatus which may be used to transport die bars through a wire insulating apparatus having parallel transport cables. The latter method is preferred as it provides a structure upon which the die bars may rest when passing through the process path during the threading operation. The leaf spring does require disengagement, rotation and disentanglement as each station for a die bar is reached. However, advantages in stability and support for a die bar, or especially for a plurality of die bars, is evident during the threading operation of such an apparatus. Nevertheless, there remains a continuing need in the art for a die bar carrier having a simpler design and which allows for die bars to be disengaged and then re-attached under the next succeeding die bar at a rate faster than that possible with the subject of the Justus application.

DISCLOSURE OF THE INVENTION

It is an object of the present invention to provide an apparatus used to support a die bar between two parallel transport cables positioned along the process path of a wire coating and drying and curing apparatus which is of a novel design and which may be utilized to release parallel transport cables and to re-engage transport cables at a rate faster than that presently available with other such apparatus.

It is a further object of the present invention to provide a novel method of transporting at least one die bar through a wire insulating apparatus having parallel transport cables located along the process path of the wire insulating apparatus which may be utilized to position die bars within the process path at appropriate stations at a rate faster than that available by present means.

These and other objects of the present invention are realized by a die bar carrier having a sleeve with one closed and one open end, two sleeve cable notches, and one sleeve wire notch situated therebetween, a slidably positioned rod within said sleeve partly extending through the open end and having two rod cable notches corresponding to the sleeve cable notches, and one rod wire notch corresponding to said sleeve filament notch situated therebetween.

A further aspect of the invention is a method of locating at least one die bar within the process path of a wire coating and drying and curing apparatus having moveable parallel transport cables located within the process path which comprises the steps of: providing a die bar carrier, engaging the die bar carrier upon the transport cables beneath at least one die bar, moving the transport cables until the die bar reaches a suitable station within the process path, and then disengaging the die bar carrier from the parallel transport cables.

Other objects and advantages of this invention will become apparent in light of the teachings of the following description of the invention and from the accompanying drawings.

BEST MODE FOR CARRYING OUT THE INVENTION

Figure 1:
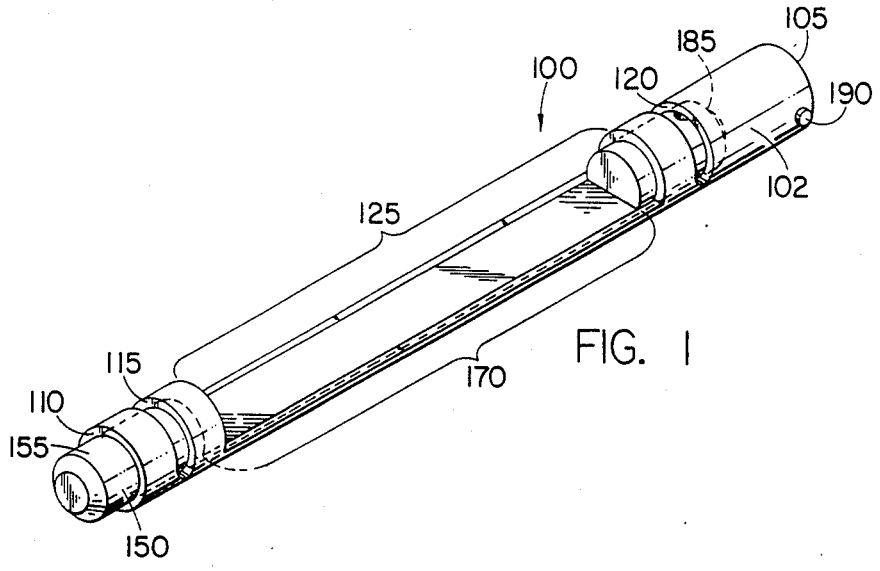
FIG. 1 is a perspective view of one embodiment of a die bar carrier.

FIG. 1 shows one embodiment of the die bar carrier 100. The sleeve 102 has one closed end 105, one open end 110, two sleeve cable notches 115 and 120 respectively, and one sleeve wire notch 125 situated therebetween. Also is shown the rod 150 slidably disposed within the sleeve 102 having a portion 155 which extends beyond the end of the sleeve 102 at its open end 110. The rod 150 has two rod cable notches 160 and 165 which correspond with the sleeve cable notches 115 and 120, and a rod wire notch 170 which corresponds with the sleeve wire notch 125. What is meant by the term "correspond" is that the rod may be slidably positioned within the sleeve so to assure that the notches, i.e. the sleeve cable notches 115, 120 and the rod cable notches 160,165, and the sleeve wire notch 125 and the rod wire notch 170 provide gaps within these notches sufficiently large to admit a transport cable and wire, respectively. More simply, this means that cables or wires may be passed through the voids when the rod is positioned so that the notches correspond.

Figure 2:
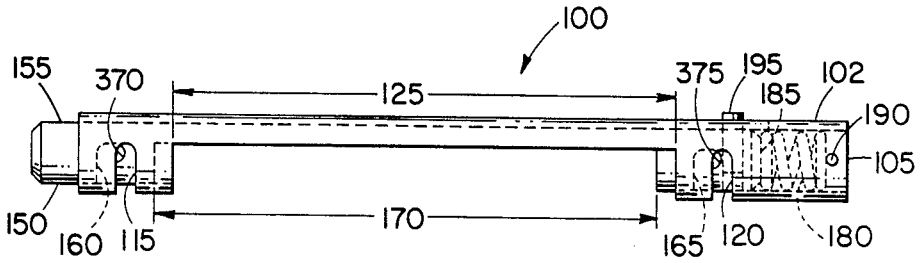
FIG. 2 is a top view of a die bar carrier showing the sleeve and the rod (in partial phantom) and a spring located within the sleeve.

FIG. 2 is a top view of a die bar carrier 100 showing the sleeve 102 and the rod 150, in partial phantom, and a spring 180 located within the sleeve 102. The sleeve 102 includes sleeve transport cable notches 115 and 120 and the sleeve wire notch 125. The rod 150 shown in partial phantom shows the rod cable notches 160 and 165 and the rod wire notch 170. Further, the illustration shows the use of a compression spring 180 positioned between the closed end of the sleeve 105 and the end of the rod 185. As illustrated in FIG. 2, the closed end 105 need not be solid but merely provide a barrier or support against which the free movement of a compressive spring 180, if used, will be limited. The use of a pin 190 passing through the sleeve 102 and acting as a means to restrict the free expansion of the compressive spring 180 is one suitable means, but other means which satisfy this objective may be used. Further, a stop pin 195 may be fastened to the rod 150 and provided to extend beyond the sleeve 102 within a slot (not shown), so to limit the free rotation of the rod 150 within the sleeve 102. Further, the size of this slot may be limited so to limit the distance of travel of the rod 150 within the sleeve 102 which may be a desired objective, as in order to limit the total travel of the rod being acted upon by a compressive spring 180 used within the die bar sleeve 102.

In FIG. 2, the rod 150 is in a position as would occur when the die bar carrier is engaged upon parallel transport cables (referred to as the noncorresponding position). The rod 150 is urged by means of the spring 180 to minimize the width of the transport cable notches 115, 160, 120, 165 and this "noncorresponding position" of the rod 150 within the sleeve 102 causes a minimiation of the available area through which a transport cable may be passed. This is desirable as this causes the transport cables to be gripped by the "noncorresponding" rod and sleeve cable notches 115, 120, 160 and 165 respectively, and thus secure the die bar carrier at a specific location between parallel transport qables. This effect is enhanced by providing notches (370, 375) along one wall of each of the rod cable notches 160, 165 in order to minimize bending stresses on the transport cables when the die bar carrier is in its noncorresponding position.

Figure 3:
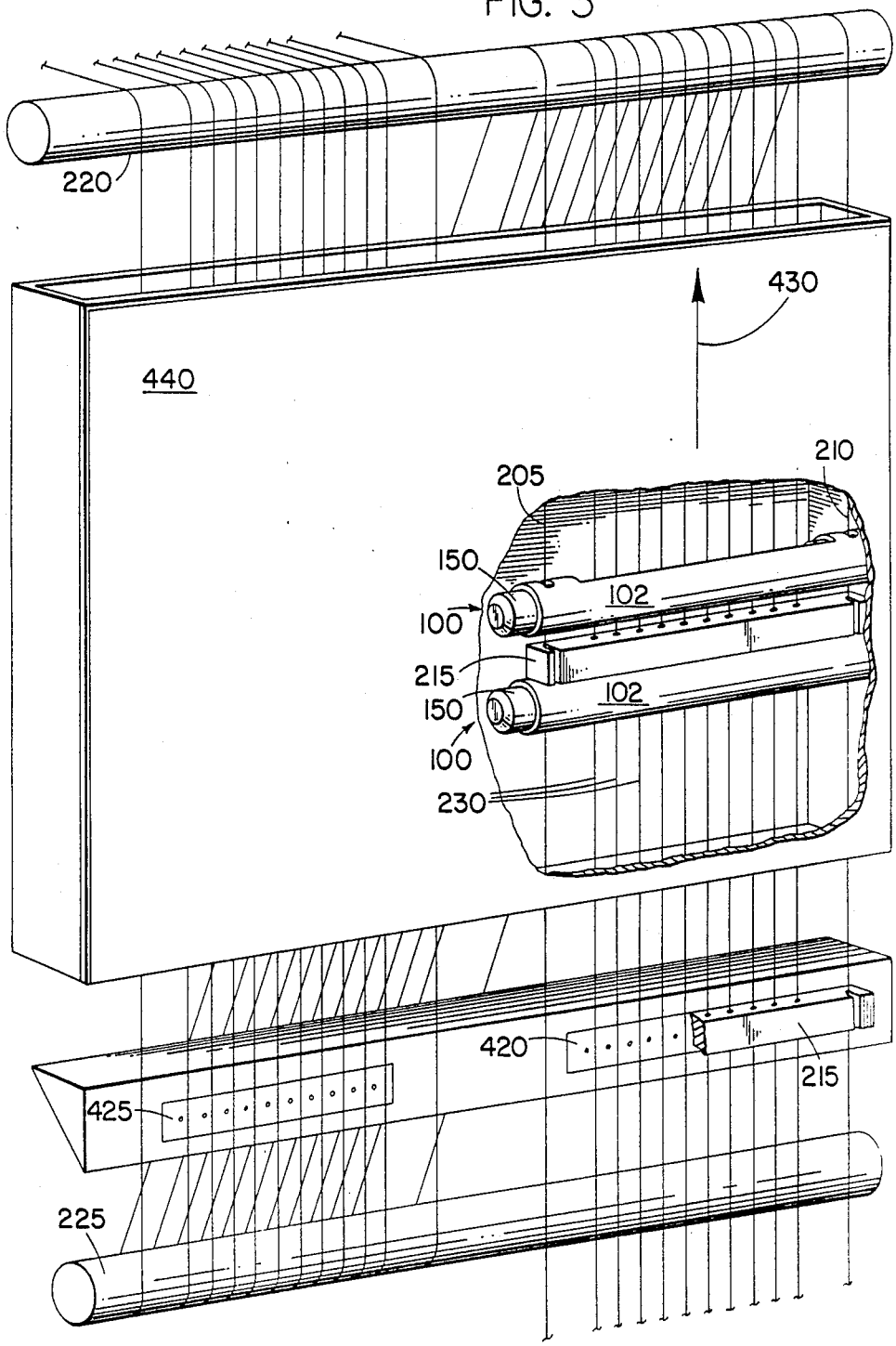
FIG. 3 is a wire insulating apparatus having parallel transport cables located along the process path, one die bar located at a coating station and a second die bar shown passing along the process path and through the oven in a cutaway view supported by a die bar carrier of the present invention.

FIG. 3 shows a view of a wire coating apparatus showing a die bar above a die bar station 420, parallel transport cables 205, 210 located within the process path 430, and the drying and curing oven of the apparatus 440. Although the transport cables are disclosed in this drawing as separate and different wire from that being enameled, it is not meant to be so limiting. These transport cables are likely to be the outer two wired of a multi-wire enameling apparatus used as transport cables during the string-up operation. Also shown within a cutaway view of the drying and curing apparatus is one embodiment of the present invention, two die bar carriers 100, fastened between parallel transport cables 205 and 210 and supporting a die bar 215 between them, within the process path of the wire coating apparaus, which further includes two sheaves 220, 225 located within the process path and at the oven entrance and exit respectively, which are utilized in a multi-pass wire coating operation to guide the wires 230 and transport cables 205 and 210 through sequential coating stations and through sequential passes.

In use, the die bar 215 is positioned between the die bar carriers 100. The die bar carriers are positioned on the transport cables 205 and 210 and the rod 150 is positioned within the sleeve 102 to assume the "corresponding" position. The parallel transport cables 205 and 210 are guided to pass within the transport cable notches of the sleeve 102 and the rod 150, and then the rod 150 is released so to allow the spring 180 to urge movement of the rod 150 towards the noncorresponding position by a spring 180, such as shown in FIG. 2, or positioned manually. Then, at least one die bar 215 is positioned above the first die bar carrier 100, and wires 230 threaded through the individual dies on the die bars and the sleeve wire notch 125 of the carrier 100. Afterwards, the transport cables 205 and 210 are engaged so to transport the die bar 215 to a suitable station 425, such as shown in FIG. 3, where it may be disengaged from the transport cables. Disengagement utilizing the present invention embodiment requires only that the rod be positioned in the "corresponding" position and easily removed from the parallel transport cables, thereby releasing the die bars which may be positioned at the station. This is done by depressing the rod 150 to compress the spring 180 and release the transport cables 205 and 210.

This process may be utilized with any number of die bars and may be repeated until all the die bars for any desired process are positioned at desired stations within the wire insulating apparatus.

The disclosed invention may be made of any desired material which exhibits sufficient heat tolerance properties so as not to deform detrimentally when exposed to the operating temperatures and conditions of the wire insulating apparatus. Among available materials, metals have been found satisfactory with steel, stainless steel and aluminum found to be very satisfactory due to good machinability characteristics and good temperature characteristics.

It should be obvious to one skilled in the art that alternative designs suitable to a particular wire coating and drying and curing apparatus may be fabricated and yet be within the scope of the contemplated invention. These may include two separate rods within a slidable sleeve so as not to extend along the total length of the sleeve, which may be elected as an alternative so to reduce the net weight and overall materials required to fabricate such an embodiment of the present invention. Also, although the best mode illustrates a die bar carrier having a cylindrical cross-section, other cross-sectional geometries are deemed to be within the scope of this invention. Further, other methods to maintain the position of the transport cable within the notch, other than the notches 370 and 375 as shown in FIG. 2, may be contemplated, among them, serrated teeth or small triangular inserts which pinch the transport cable and thus also insure a sufficiently good grip upon the parallel transport cables.

The present disclosed invention and method of use provides a superior apparatus and method by which die bars may be transported and positioned within a wire insulating apparatus having parallel transport cables along the process path. The disclosed invention allows for an operator to simply and quickly disengage a die bar carrier and re-engage it at any position between the parallel transport cables within the process path without the necessity of extended stoppage of the parallel transport cables which tends to cause the wire within the drying and curing portion to be exposed to excessive oven residence times resulting in inferior wire which must be discarded. Further, the disclosed invention requires minimal contact with the die bar carrier by a human operator, which, by virtue of multiple passes through a drying and curing portion of a wire coating apparatus, has accumulated sufficient heat to cause substantial likelihood of burn and injury to an operator.

It should be understood that the invention is not limited to the particular embodiments shown and described herein, but that various changes and modifications may be made without departing from the spirit and scope of this novel concept as defined by the following claims.

I claim:

1. A die bar carrier comprising a sleeve having one closed end and one open end, two sleeve cable notches, one sleeve filament situated therebetween, and a rod slidably positioned within said sleeve and partly extending through said open end having two rod cable notches corresponding to said sleeve cable notches, a compression spring positioned between the closed end of the sleeve and the end of the rod, and one rod filament notch situated therebetween said rod filament notch positioned to permit the free passage of magnet wire through said notch.

2. A die bar carrier as in claim 1 which further comprises a cable notch within each rod cable notch.

* * * * *

UNITED STATES PATENT AND TRADEMARK OFFICE

CERTIFICATE OF CORRECTION

PATENT NO. : 4,773,353

DATED : September 27, 1988

INVENTOR(S) : Mohammad F. Zaman

It is certified that error appears in the above-identified patent and that said Letters Patent is hereby corrected as shown below:

In the specification, Column 5 line 7, "minimia" should be - - minimiza --; line 27, "wired" should be - - wires - -.

Column 6, Claim 1 line 57, after "filament" insert - - notch - -; line 64, delete "magnet wire" and insert - - filament - -.

Signed and Sealed this

Twelfth Day of September, 1989

*Attest:*

*Attesting Officer*

DONALD J. QUIGG

*Commissioner of Patents and Trademarks*